US008230764B1

(12) United States Patent
Lee

(10) Patent No.: US 8,230,764 B1
(45) Date of Patent: Jul. 31, 2012

(54) RATCHET WRENCH

(76) Inventor: Hong-Jen Lee, Taichung (TW)

( * ) Notice: Subject to any disclaimer, the term of this patent is extended or adjusted under 35 U.S.C. 154(b) by 0 days.

(21) Appl. No.: 13/163,762

(22) Filed: Jun. 20, 2011

(51) Int. Cl.
*B25B 13/46* (2006.01)

(52) U.S. Cl. ..... 81/63; 81/177.85

(58) Field of Classification Search ..... 81/61–63.2, 81/177.85
See application file for complete search history.

(56) References Cited

U.S. PATENT DOCUMENTS 6,138,532 A * 10/2000 McCann ..... 81/63
6,457,386 B1 * 10/2002 Chiang ..... 81/62
6,862,956 B1 * 3/2005 Chen ..... 81/63.2
7,004,052 B1 * 2/2006 Shu-Sui et al. ..... 81/63
7,302,876 B1 * 12/2007 Lee ..... 81/177.9
2006/0000317 A1 * 1/2006 Chen ..... 81/63.2
2010/0263496 A1 * 10/2010 Hung ..... 81/63.2

* cited by examiner

*Primary Examiner* — Debra S Meislin

(57) ABSTRACT

The present invention discloses a ratchet wrench, which includes a body, a driving head, a fixing disk and a rotatable member. The body has a ring-shaped head with internal teeth therein. The driving head is located in the ring-shaped head and has a top portion which has a reception recess and a pawl is located in the reception recess. The pawl has engaging teeth on two ends of the front thereof and two curved surfaces are formed on the back of the pawl. A spring is located in the reception recess so as to bias the back of the pawl. The rotatable member is located on the top of the ring-shaped head and has two driving pins which shift the spring to pivot the pawl such that the engaging teeth in one of the two ends of the pawl are engaged with the internal teeth to control the driving head to rotate in one direction.

12 Claims, 14 Drawing Sheets

RATCHET WRENCH

FIELD OF THE INVENTION

The present invention relates to a wrench, and more particularly to a ratchet wrench.

BACKGROUND OF THE INVENTION

A conventional ratchet wrench is disclosed in U.S. Pat. No. 6,138,532 and comprises a handle having a head provided thereon and an internal gear is provided in the head. A recess is defined in the head. The head has a control hole defined in the top thereof and an engaging portion on the underside of the head. A pawl is pivotally secured in the recess and has teeth on two ends thereof which are selectively actuated to act onto the internal gear. A shaft is rotatable received in the control hole and includes a spring-biased projection engaged with said pawl for selectively actuating either of the ends of the pawl to engage with the internal gear. The upper portion of the shaft includes an opening so as to accommodate the spring and the end pieces which are biased against the back of the pawl. By rotating the shaft, the teeth of the pawl are engaged with the internal gear to control the operation direction of the wrench.

However, the pawl located in the recess does not have any assistant force to support the pawl so that when rotating the wrench, the torque reacted from the object is transferred to the pawl and the shaft. The shaft is thin and easily broken.

The recess is defined transversely so that it requires a lot of steps to make the recess in the head.

The control shaft is located in the control hole pawl and has an operation portion located above the driving head for the user to shift, the operation portion is located only on one side of the head and is not convenient for the users.

SUMMARY OF THE INVENTION

The present invention relates to a ratchet wrench and comprises a body, a driving head, a fixing disk, a rotatable member and a clip. The body has a ring-shaped head with internal teeth defined therein. The driving head is located in the ring-shaped head and has a top portion which has a reception recess and a pawl is located in the reception recess. The pawl has engaging teeth on two ends of the front thereof and two curved surfaces are formed on the back of the pawl. A spring is located in the reception recess so as to bias the back of the pawl. The rotatable member is located on the top of the ring-shaped head and has two driving pins extending from the underside thereof. When rotating the rotatable member, the driving pins shift the spring to pivot the pawl such that the engaging teeth in one of the two ends of the pawl are engaged with the internal teeth to control the driving head to rotate in one direction.

The primary object of the present invention is to provide a ratchet wrench wherein the reaction force from the object is shared by multiple parts so that the pawl is protected and the wrench has longer life of use.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 3:
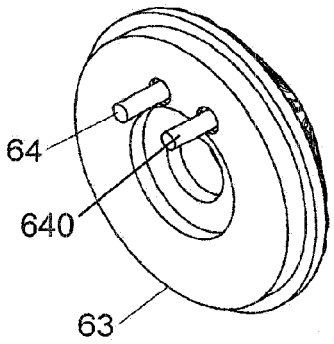
FIG. 3 is a perspective view to show the rotatable member of the ratchet wrench of the present invention.
Figure 2:
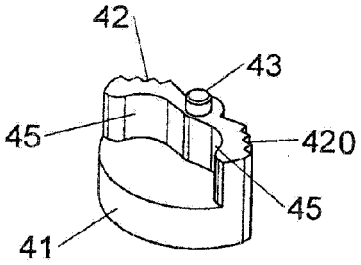
FIG. 2 is a perspective view to show the pawl of the ratchet wrench of the present invention.

Referring to FIGS. 1 to 11, the ratchet wrench of the present invention comprises a body 10, a driving head 20, a fixing disk 30, a rotatable member 60, a clip 70 and a quick-release unit 80.

The body 10 includes a ring-shaped head 100 connected thereto and the ring-shaped head 100 has multiple internal teeth 11 defined therein. The ring-shaped head 100 has an upper recess 12 and a lower recess 13 defined therein and the internal teeth 11 are located between the upper and lower recesses 12, 13. The inner diameter of each of the upper and lower recesses 12, 13 are larger than the portion where the internal teeth 11 extend from.

The driving head 20 is rotatably located in the ring-shaped head 100 and has a flange 21 extending from the mediate portion of the outer surface thereof. The flange 21 is engaged with the lower recess 13 of the ring-shaped head 100. A top portion 22 extends from the top of the driving head 20 and is located in the mediate portion of the ring-shaped head 100. At least one reception recess 221 is defined in the outer surface of the driving head 20 and has a semi-circular inside. A control unit 4 is received in the at least one reception recess 221 and has a reception hole 222 defined in the inner end of the at least one reception recess 221. A first hole 223 is defined through the flange 21 and communicates with the at least one reception recess 221. The axis of the reception hole 222 is perpendicular to the axis of the driving head 20. The at least one reception recess 221 has two parallel notches 224 defined in the inside thereof and the reception hole 222 is located between the two notches 224. The axes of the two notches 224 are parallel to the axis of the driving head 20. The top portion 22 has a protrusion 23 on the top thereof and the protrusion 23 has a connection portion 231 on the top thereof. The connection portion 231 has outer threads. The protrusion 23 has a groove 232 defined in the lower portion thereof. The driving head 20 has a polygonal engaging portion 24 extending from the underside thereof so as to be connected with a socket (not shown). The engaging portion 24 of the driving head 20 has a first passage 25 defined therethrough which has a stepped inner periphery. The engaging portion 24 has a bead hole 26 defined in side thereof and communicating with the first passage 25.

The pawl 40 has pivot 43 extending from the top and the bottom thereof. The pawl 40 is pivtoably engaged with the at least one reception recess 221 by extending the two ends of the pivot 43 through the first hole 223. The pawl 40 has a curved portion 41 on the back thereof and the curved portion 41 is matched with the semi-circular inside of the at least one reception recess 221. The curved portion 41 and the semi-circular inside of the at least one reception recess 221 have the same radius. Multiple engaging teeth 42 are formed on the front of the pawl 40 and located at two ends of the front of the pawl 40. The height of the engaging teeth 42 is higher than that of the curved portion 41 so that the pawl 40 has a substantially L-shaped cross section. Two curved surfaces 45 are formed on the back of the pawl 40 and located corresponding to the engaging teeth 42 on two ends of the front of the pawl 40. The curved surfaces 45 are located above the curved portion 41. A spring 51 is located in the reception hole 222. Two end pieces 50, 52 are respectively connected to the first and second ends of the spring 51. The end piece 52 is engaged with the reception hole 222 and the end piece 50 contacts one of the curved surfaces 45. The engaging teeth 42 of one of the two ends of the front of the pawl 40 are engaged with the internal teeth 11 of the ring-shaped head 100 when the pawl 40 is pivoted in the at least one reception recess 221.

The fixing disk 30 is located in the ring-shaped head 100 and rested on the top of the top portion 22. The fixing disk 30 has a central hole 31 and the protrusion 23 extends through the central hole 31. At least one slot 33 and at least one second hole 32 are defined through the fixing disk 30. Two ends of the pivot 43 are respectively engaged with the at least one slot 32 and the first hole 223. The at least one slot 33 is located between the central hole 31 and the at least one slot 32. A clip 34 is engaged with the groove 232 to contact the top of the fixing disk 30 which is then connected to the driving head 20.

Figure 11:
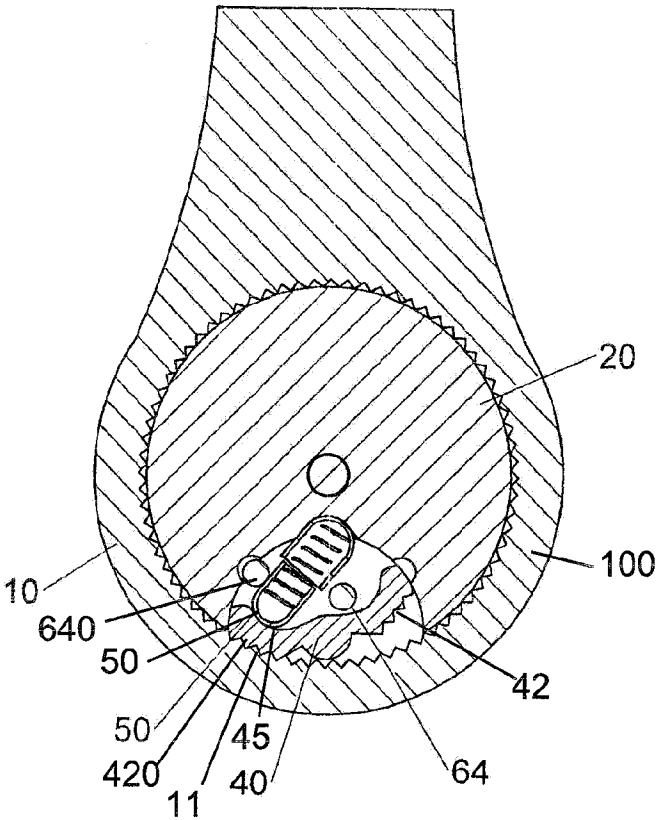
FIG. 11 is a cross sectional view of the ratchet wrench of the present invention, wherein the pawl is pivoted.

The rotatable member 60 is mounted to the ring-shaped head 100 and has patterns formed on the top to form knurled surface for the user to rotate it. A bore 61 is defined centrally in the rotatable member 60 and a through hole 610 is defined in the rotatable member 60. The through hole 610 communicates with the bore 61 and is smaller than the bore 61 so that a lip 62 is formed in the rotatable member 60. The protrusion 23 extends through the through hole 610 and is located in the bore 61. The rotatable member 60 has an outer surface 63 with a reduced diameter on the underside thereof and the outer surface 63 is engaged with the upper recess 12 of the ring-shaped head 100. At least two driving pins 64, 640 extend from the underside of the rotatable member 60 and extend through the slot 33 and are inserted into the at least one reception recess 221. The spring 51 is located between the at least two driving pins 64, 640. As shown in FIG. 11, when rotating the rotatable member 60, one of the at least two driving pins 64, 640 pushes the spring 51 which rotates the pawl 40 and the engaging teeth 42 of one of the two ends of the front of the pawl 40 are engaged with the internal teeth 11 in the ring-shaped head 100. The clip 70 has inner threads which are connected with the outer threads of the connection portion 231 so as to contact the lip 62 of the rotatable member 60, such that the rotatable member 60 is rotatably connected to the driving head 20.

The quick-release unit 80 includes a control shaft 81, a button 82, a spring 83 and a bead 84, wherein the control shaft 81 extends through the first passage 25 and has a bead recess 811 defined therein which is located corresponding to the bead hole 26.

The control shaft 81 has a connection portion 812 on the top thereof. The connection portion 812 has outer threads and extends out from the first passage 25. The bore 61 of the rotatable member 60 accommodates the button 82 and the spring 83 therein. The button 82 has a threaded hole 820 in the underside thereof so as to be connected with the connection portion 812 of the control shaft 81. The spring 83 contacts between the lip 62 and the button 82. The bead 84 is located in the bead recess 811 and the bead hole 26.

Figure 4:
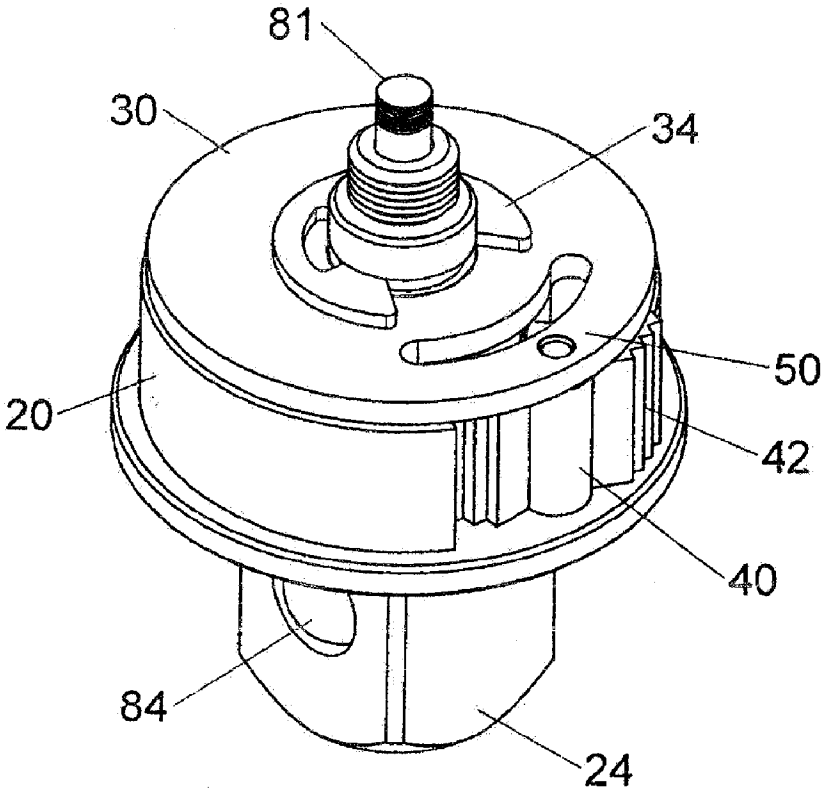
FIG. 4 is a perspective view to show a portion of the rotatable member of the ratchet wrench of the present invention.

When in assembling, the pawl 40 is pivotably connected to the at least one reception recess 221 and the curved portion 41 is matched with the inside of the at least one reception recess 221. The lower end of the pivot 43 is engaged with the first hole 223 and the end piece 52 is located in the reception hole 222. The end piece 50 is biased by the spring 51 and contacts the curved surface 45. The control shaft 81 extends through the first passage 25 and the connection portion 812 3xtends from the first passage 25. The bead 84 is located between the bead hole 26 and the bead recess 811. The fixing disk 30 is mounted the protrusion 23 by the central hole 31. The C-shaped clip 34 is engaged with the groove 232 of the protrusion 23 and positions the fixing disk 30 which is secured on the driving head 20. The top end of the pivot 43 extends through the second hole 32 as shown in FIG. 4.

Figure 5:
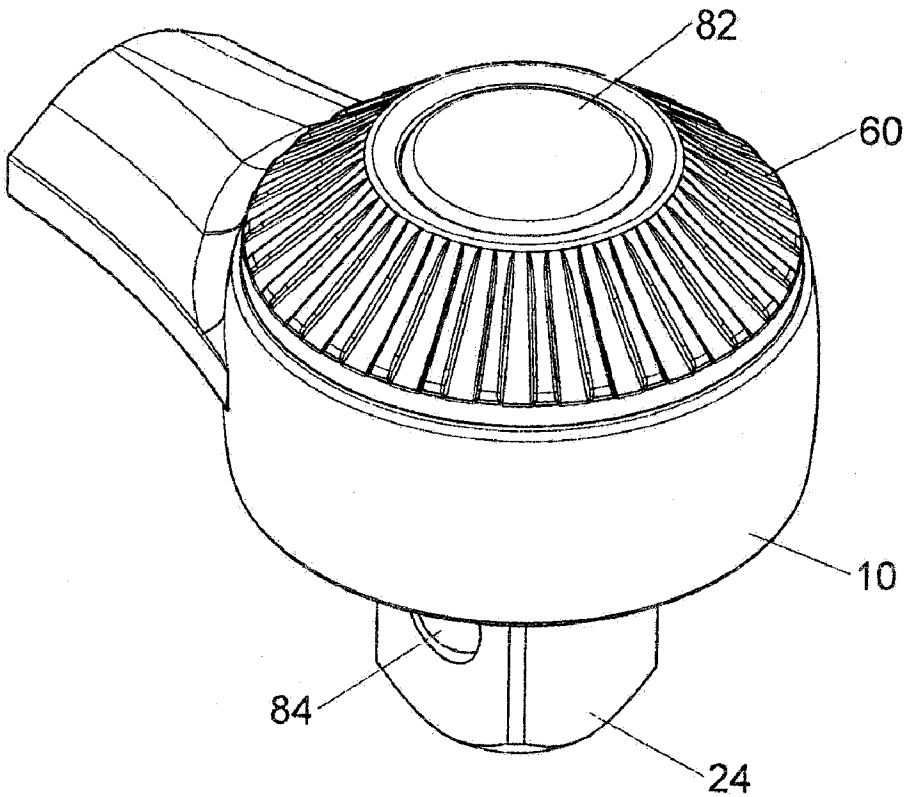
FIG. 5 is a perspective view to show the ratchet wrench of the present invention.
Figure 7:
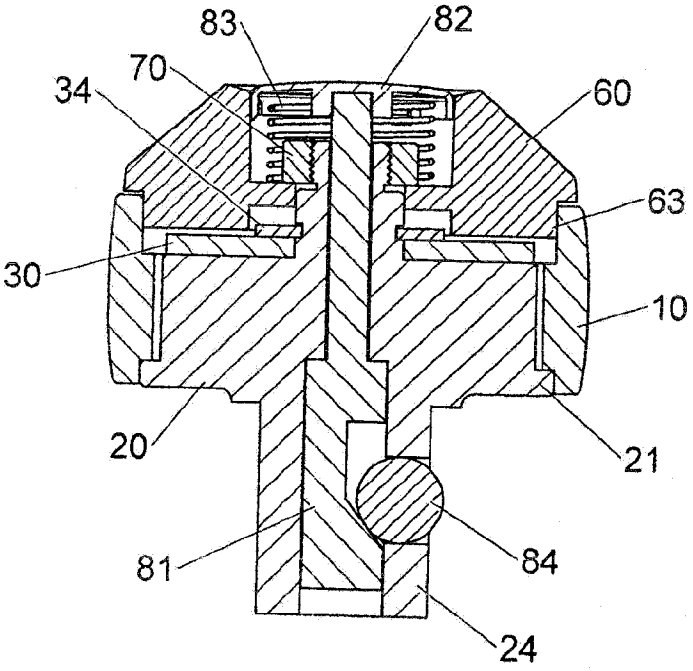
FIG. 7 is a cross sectional view, taken along line A-A in FIG. 6.
Figure 6:
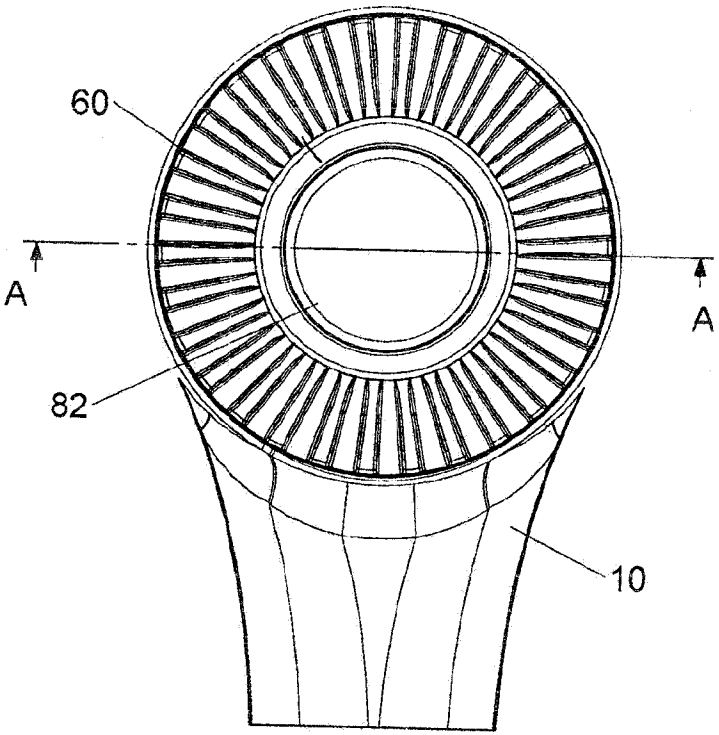
FIG. 6 is a top view of the ratchet wrench of the present invention.

The flange 21 of the driving head 20 is rotatably engaged with the lower recess 13 and the rotatable member 60 is mounted to the top opening of the ring-shaped head 100. The outer surface 63 of the rotatable member 60 is rotatably engaged with the upper recess 12. The driving pins 64, 640 extend through the slot 33 and the clip 70 is located in the bore 61 and is connected to the connection portion 231. The button 82 is threadedly connected to the connection portion 812 and the spring 83 is biased between the button 82 and the lip 62 of the rotatable member 60, as shown in FIGS. 5 to 7.

Figure 9:
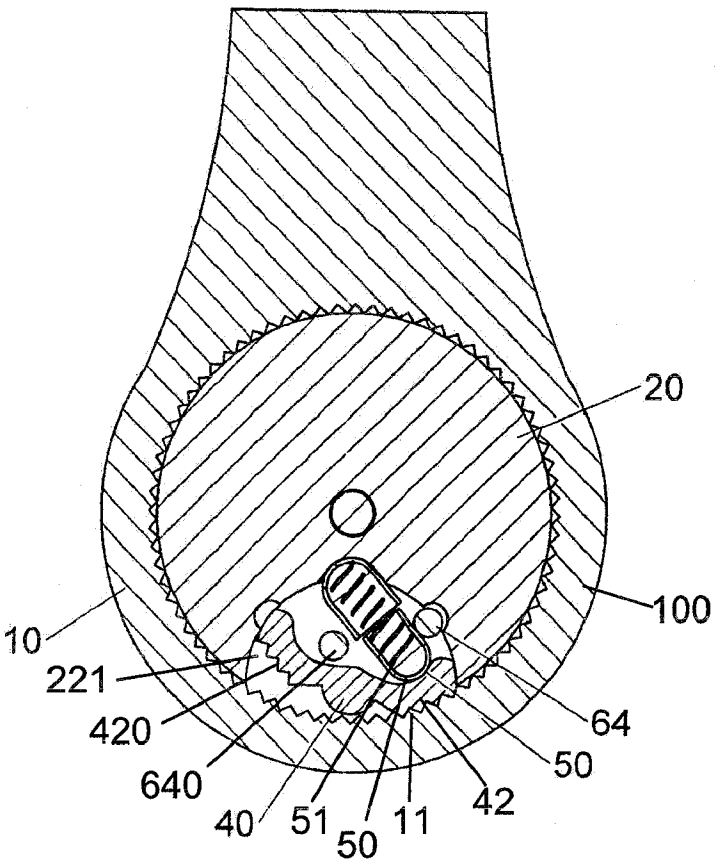
FIG. 9 is a cross sectional view, taken along line B-B in FIG. 8.
Figure 8:
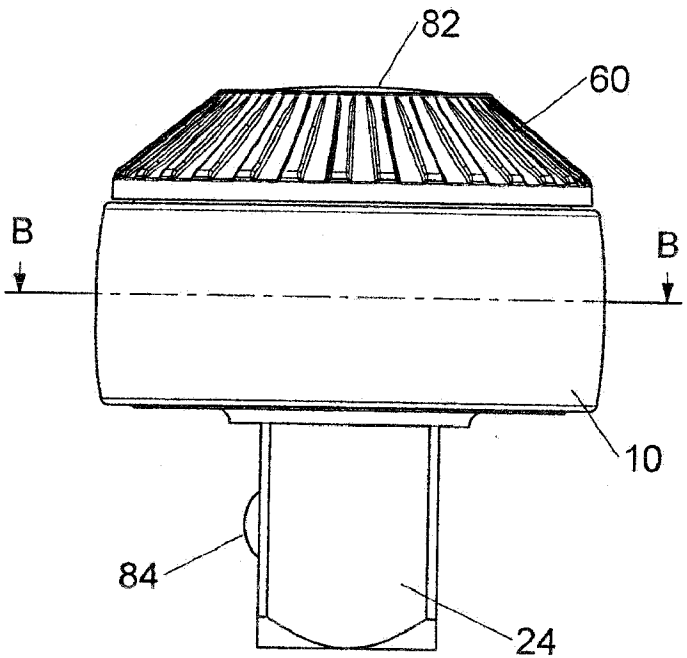
FIG. 8 is a front view of the ratchet wrench of the present invention.
Figure 10:
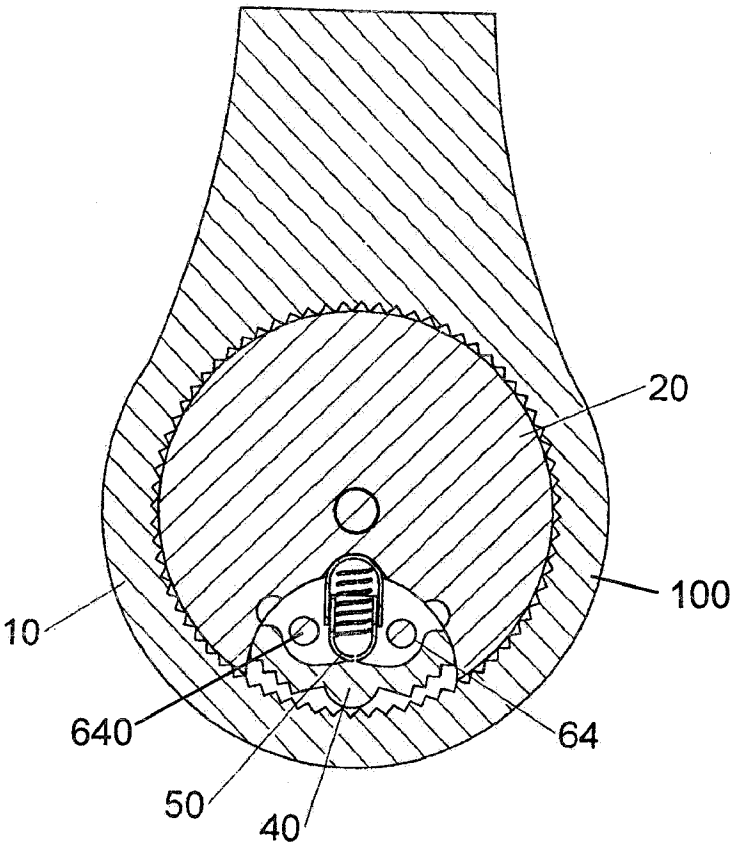
FIG. 10 is a cross sectional view of the ratchet wrench of the present invention.

As shown in FIG. 10, the driving pins 64, 640 are located on outside of the two end pieces 50, 52. As shown in FIG. 9, when the user rotates the rotatable member 60 counter clockwise, the driving pin 640 pushes the end piece 50 and the other driving pin 64 is received in the notch 224. The end piece 50 contacts the curved surface 45 and the pawl 40 is pivoted in the at least one reception recess 221, the engaging teeth 42 on one end of the pawl 40 are engaged with the internal teeth 11 so that the wrench is rotated clockwise. As shown in FIG. 11, when the user rotates the rotatable member 60 clockwise, the driving pin 64 pushes the end piece 50 and the other driving pin 640 is received in the notch 224. The pawl 40 is pivoted in the at least one reception recess 221, the engaging teeth 42 on the other end of the pawl 40 are engaged with the internal teeth 11 so that the wrench is rotated counter clockwise.

Figure 13:
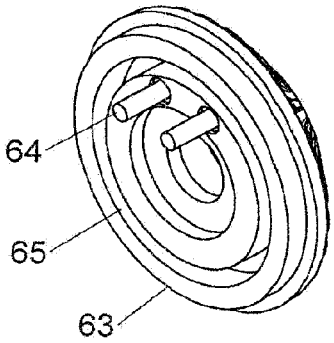
FIG. 13 shows the rotatable member of the second embodiment of the ratchet wrench of the present invention.
Figure 12:
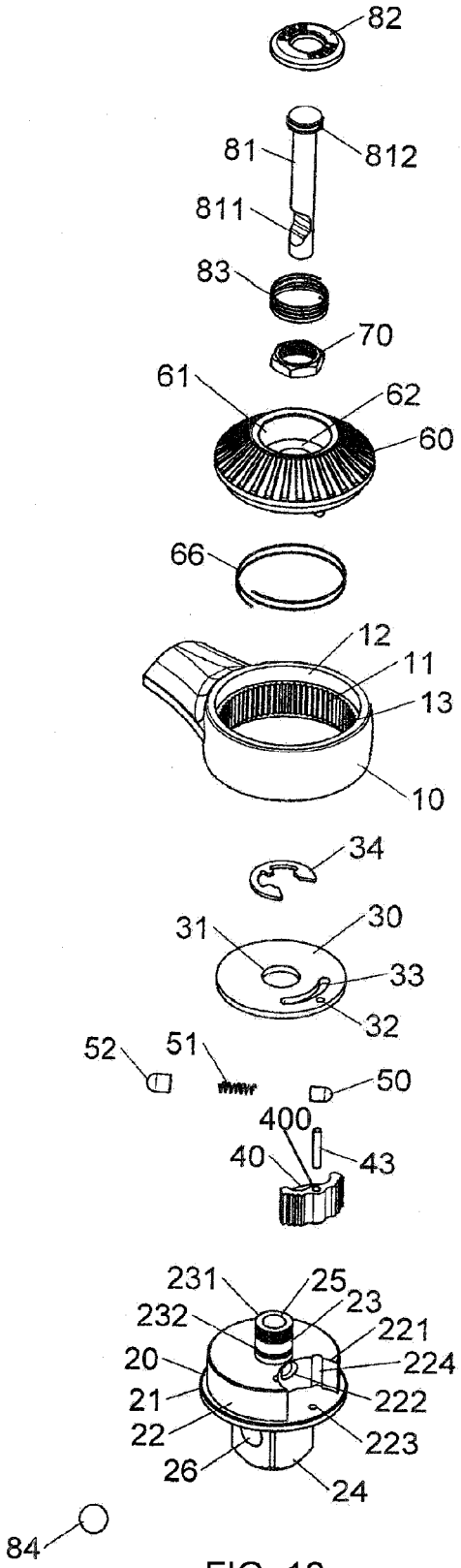
FIG. 12 is the exploded view of the second embodiment of the ratchet wrench of the present invention.
Figure 14:
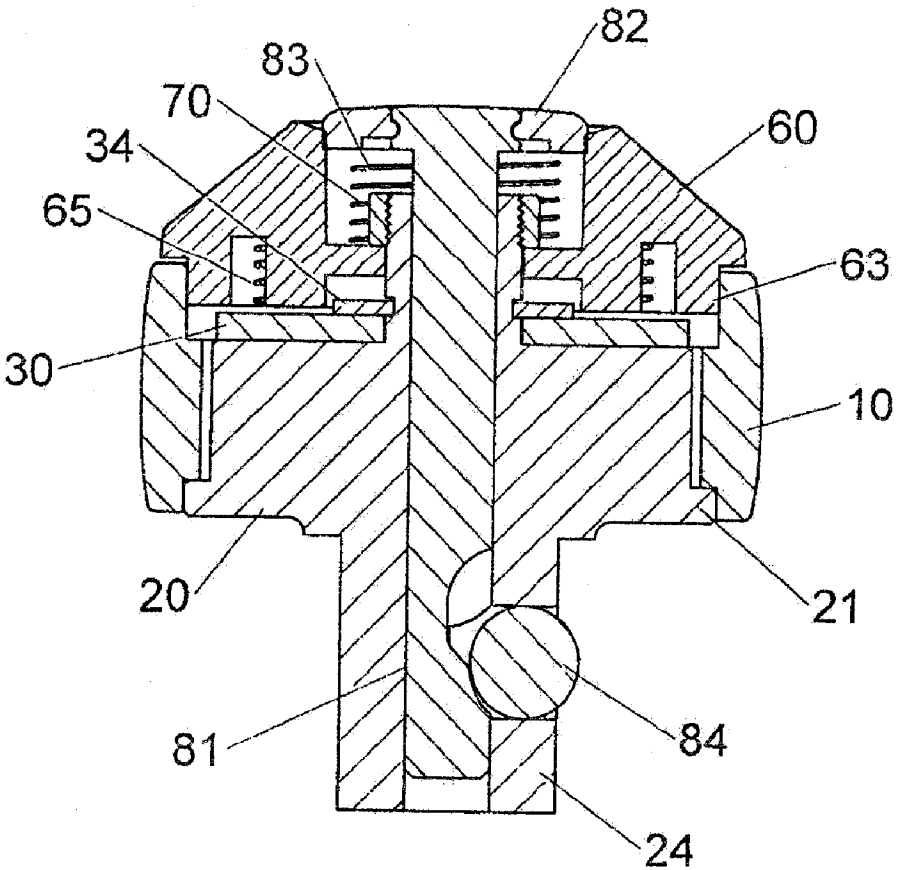
FIG. 14 is a cross sectional view of the second embodiment of the ratchet wrench of the present invention.

As shown in FIGS. 12 to 14, the pawl 40 has a passage 400 defined therethrough and the pivot 43 extends through the first hole 223. An annular recess 65 is defined in the rotatable member 60 and a spring 66 is located in the annular recess 65 and located between the rotatable member 60 and the fixing disk 30. The control shaft 81 extends through the first passage 25. The connection portion 812 is an annular groove and the button 82 is engaged with the connection portion 812.

Figure 15:
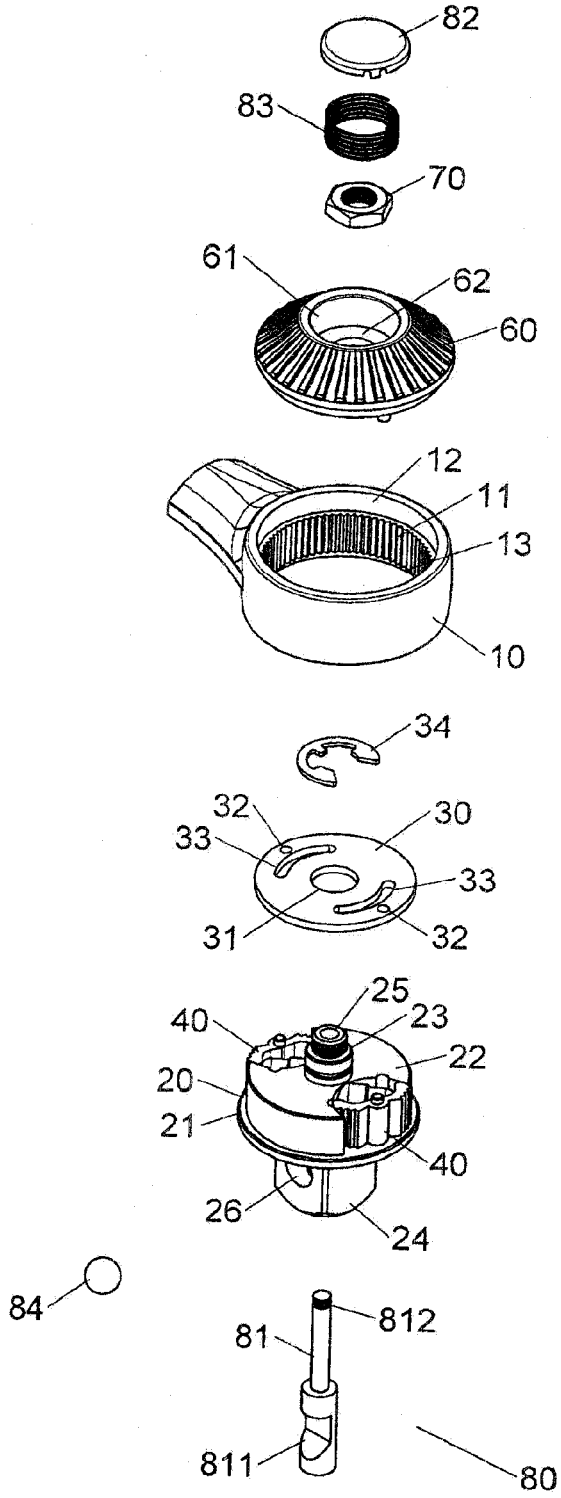
FIG. 15 is the exploded view of the third embodiment of the ratchet wrench of the present invention.
Figure 16:
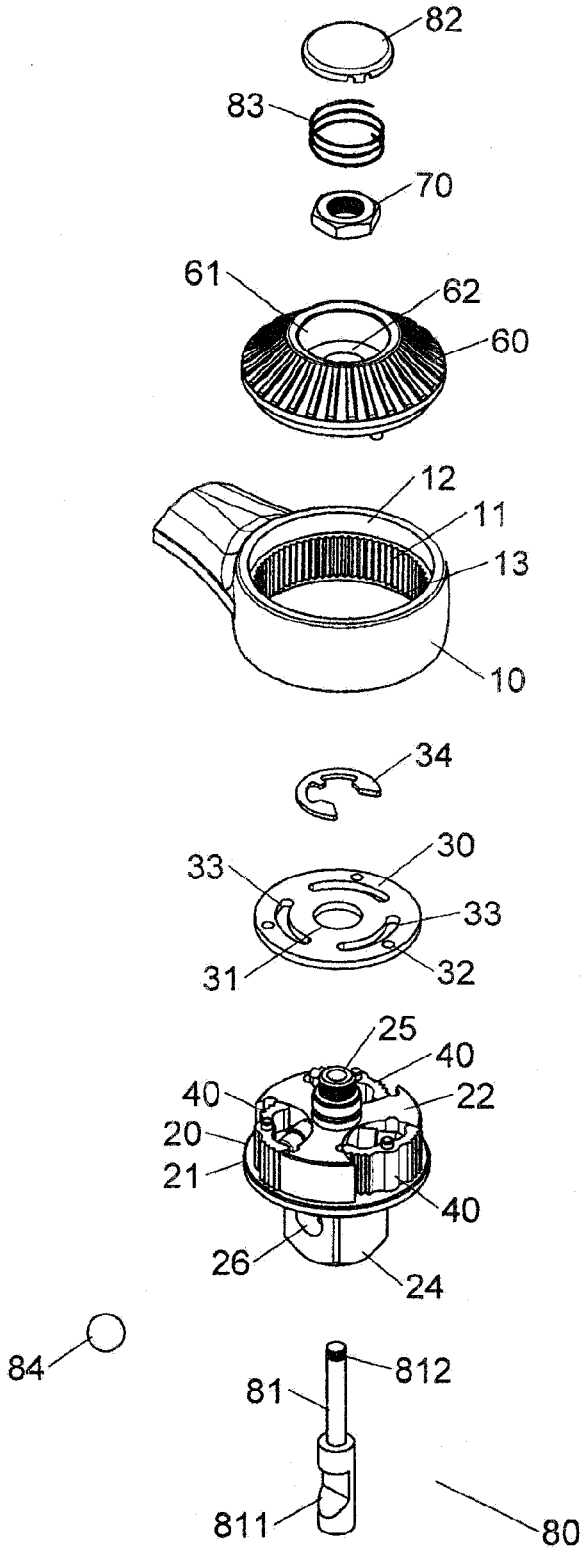
FIG. 16 is the exploded view of the fourth embodiment of the ratchet wrench of the present invention.

As shown in FIGS. 15 and 16, multiple control units 4 are located on the top portion 22 and multiple engaging teeth 42 are engaged with the internal teeth 11 to provide more torque. FIGS. 15 and 16 show the embodiments with two and three control units 4. That is to say, the at least one reception recess 221 includes two reception recesses 221 which are defined in the outer surface of the driving head 20. Each of the two reception recesses 221 has a control unit 4 received therein. The control units 4 each have the pawl 40, the reception hole 222 and the spring 51 as mentioned above. The fixing disk 30 has two second holes 32 and two slots 33. The rotatable member 60 has two pairs of the driving pins 64, 640 so as to be cooperated with the two respective springs 51 and drive the pawls 40.

Figure 17:
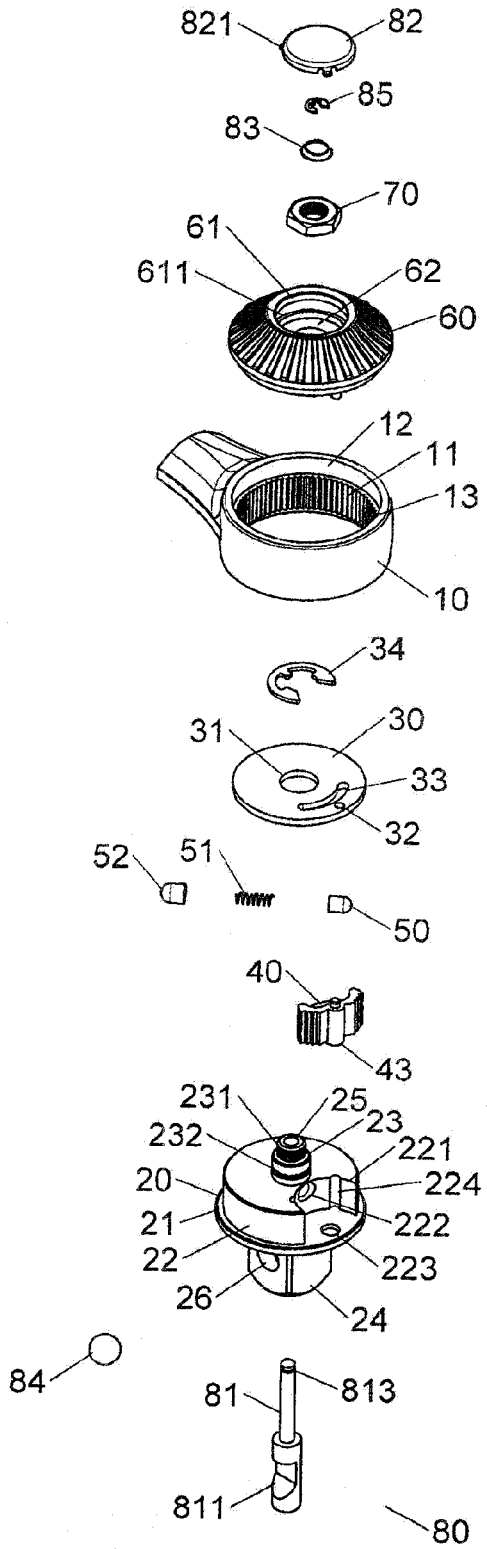
FIG. 17 is the exploded view of the fifth embodiment of the ratchet wrench of the present invention.
Figure 18:
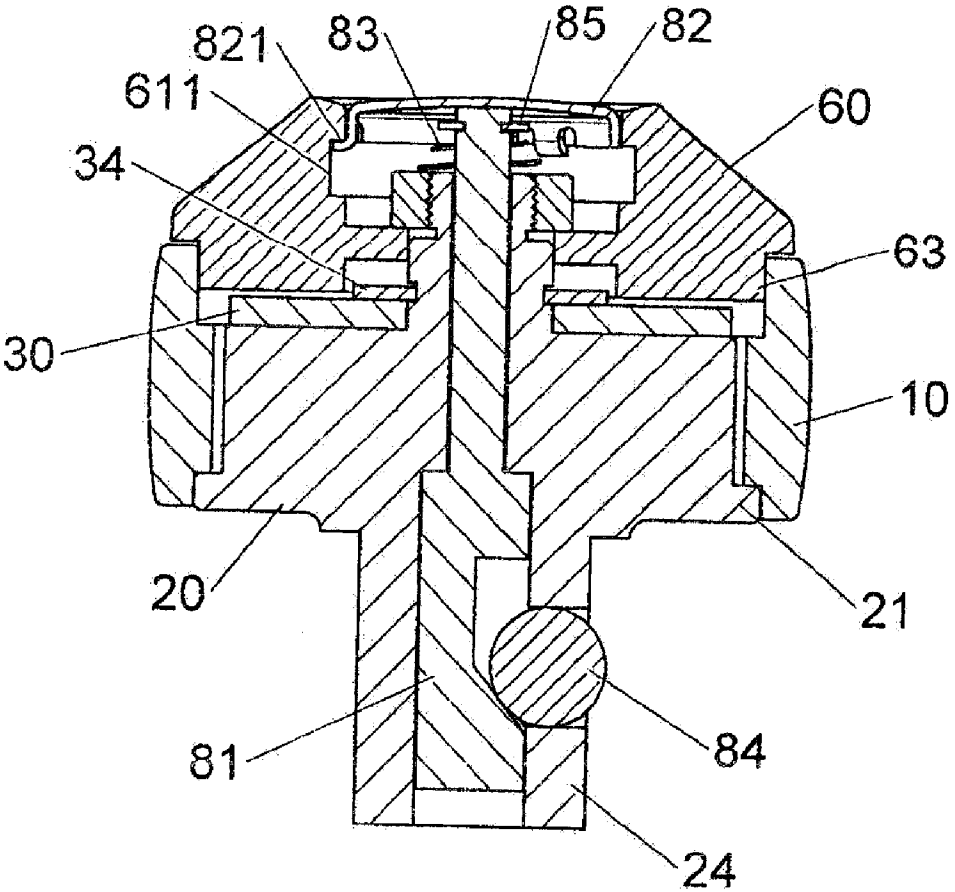
FIG. 18 is the cross sectional view of the fifth embodiment of the ratchet wrench of the present invention.

As shown in FIGS. 17 and 18, the bore 61 includes a groove 611 defined in the inner periphery thereof and the button 82 has multiple hooks 821 on the periphery thereof. The hooks 821 are engaged with the groove 611. A clip 85 is engaged with the groove 813 defined in the top of the control shaft 81. The top of the control shaft 81 contacts the underside of the button 82 and the spring 83 is biased between the clip 85 and the clip 70.

Figure 19:
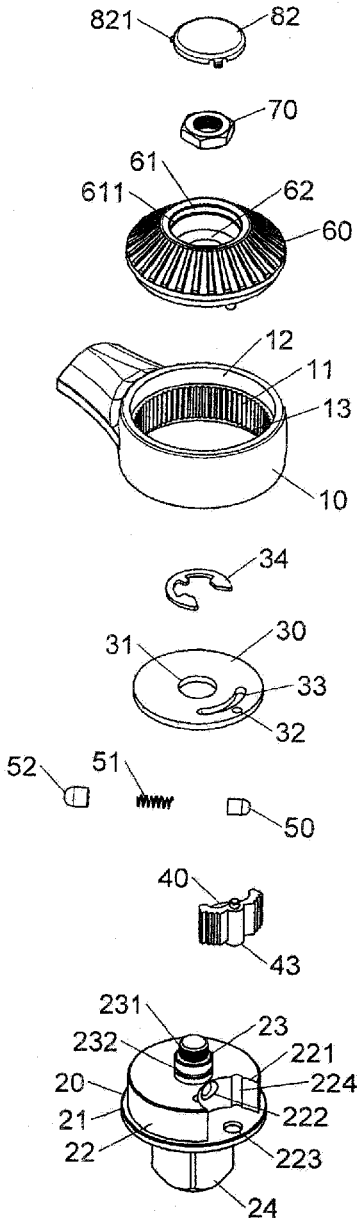
FIG. 19 is the exploded view of the sixth embodiment of the ratchet wrench of the present invention.

FIG. 19 shows that the embodiment does not have the quick-release unit 80, only a button 82 hooked to the groove 611 of the rotatable member 60.

Referring to FIGS. 9 to 11, the pawl 40 has a curved portion 41 on the back thereof and the curved portion 41 is pivotably engaged with the curved inside of the at least one reception recess 221. When the rotatable member 60 is rotated, the driving pins 64, 640 move the end piece 50 to contact the curved surface 45 to pivot the pawl 40 so as to control the engagement between the engaging teeth 42 and the internal teeth 11. The force applied to the pawl 40 is evenly dispensed by the curved portion 41 so that the pawl 40 is not broken.

Figure 1:
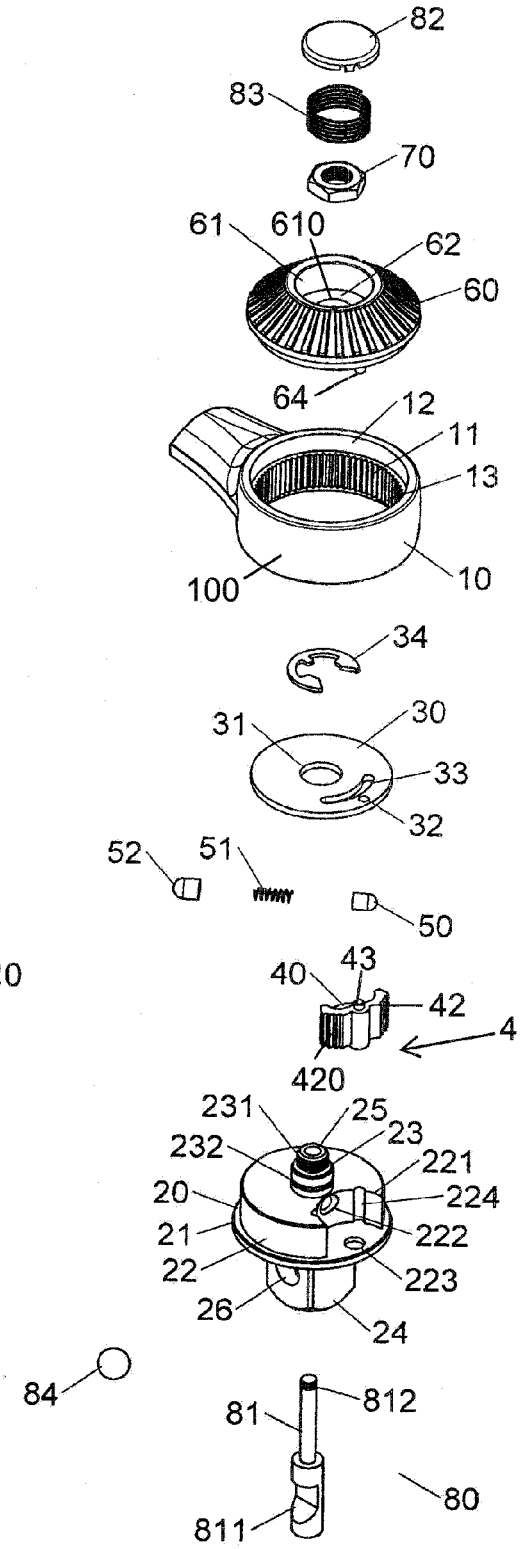
FIG. 1 is an exploded view to show the ratchet wrench of the present invention.

Referring to FIGS. 1 and 4, the driving head 20, the fixing disk 30, the pawl 40 and the spring 51 can be assembled as a module and then the module is installed to the body 10 so as to simply the assembly processes (as shown in FIG. 4).

Referring to FIGS. 1 and 7, the ring-shaped head 100 has internal teeth 11, the upper recess 12 and the lower recess 13, and the driving head 20 is engaged with the lower recess 13 by the flange 21. The rotatable member 60 has the outer surface 63 so as to be engaged with the upper recess 12. The assembly of the ring-shaped head 100, the driving head 20, the pawl 40 and the rotatable member 60 are well supported and connected. The rotatable member 60 is rotatably engaged with the top opening of the ring-shaped head 100 and has patterns to form knurled surface so that the user can easily rotate the rotatable member 60.

While we have shown and described the embodiment in accordance with the present invention, it should be clear to those skilled in the art that further embodiments may be made without departing from the scope of the present invention.

What is claimed is:

1. A ratchet wrench comprising:

a body (10) having a ring-shaped head (100) connected thereto and the ring-shaped head (100) having multiple internal teeth (11) defined therein, the ring-shaped head (100) having an upper recess (12) and a lower recess (13) defined therein and the internal teeth (11) located between the upper and lower recesses (12, 13);

a driving head (20) having a flange (21) extending from a mediate portion of an outer surface thereof, the flange (21) engaged with the lower recess (13) of the ring-shaped head (100), a top portion (22) extending from a top of the driving head (20) and located in a mediate portion of the ring-shaped head (100), at least one reception recess (221) defined in the outer surface of the driving head (20) and having a semi-circular inside, the top portion (22) having a protrusion (23) on a top thereof, the protrusion (23) having a connection portion (231) on a top thereof and the connection portion (231) having outer threads, the protrusion (23) having a groove (232) defined in a lower portion thereof, the driving head (20) having a polygonal engaging portion (24) extending from an underside thereof;

a control unit (4) received in the at least one reception recess and having a reception hole (222) defined in an inner end of the at least one reception recess (221), a first hole (223) defined through the flange (21) and communicating with the at least one reception recess (221), an axis of the reception hole (222) being perpendicular to an axis of the driving head (20), a first end of a spring (51) engaged with the at least one reception recess (221);

a pawl (40) having pivot (43) extending from a top and a bottom thereof, the pawl (40) pivtoably engaged with the at least one reception recess (221), the pawl (40) having a curved portion (41) on a back thereof and the curved portion (41) matched with the semi-circular inside of the at least one reception recess (221), the curved portion (41) and the semi-circular inside of the at least one reception recess (221) having the same radius, multiple engaging teeth (42) formed on a front of the pawl (40) and located at two ends of the front of the pawl (40), a height of the engaging teeth (42) being higher than that of the curved portion (41) so that the pawl (40) having a substantially L-shaped cross section, the engaging teeth (42) of one of the two ends of the front of the pawl (40) being engaged with the internal teeth (11) of the ring-shaped head (100 when the pawl (40 is pivoted in the at least one reception recess (221), two curved surfaces (45) being formed on the back of the pawl (40) and located corresponding to the engaging teeth (42) on two ends of the front of the pawl (40), the curved surfaces (45) located above the curved portion (41), a second end of the spring (51) engaged with the one of the two curved surfaces (45);

a fixing disk (30) located in the ring-shaped head (100) and rested on a top of the top portion (22), the fixing disk (30) having a central hole (31) and the protrusion (23) extending through the central hole (31), at least one slot (33) and a at least one second hole (32) defined through the fixing disk (30), two ends of the pivot (43) respectively engaged with the at least one slot (32) and the first hole (223);

a C-shaped clip (34) engaged with the groove (232) of the protrusion (23) and positioning the fixing disk (30) which is secured on the driving head (20), and a rotatable member (60) mounted to the ring-shaped head (100) and having a bore (61) defined centrally therein and a through hole (610) defined in the rotatable member (60), the through hole (610) communicating with the bore (61) and being smaller than the bore (61) so that a lip (62) is formed in the rotatable member (60), the protrusion (23) extending through the through hole (610) and located in the bore (61), the rotatable member (60) having an outer surface (63) with a reduced diameter on an underside thereof and the outer surface (63) engaged with the upper recess (12) of the ring-shaped head (100), at least two driving pins (64, 640) extending from the underside of the rotatable member (60) and extending through the slot (33) and inserted into the at least one reception recess (221), the spring (51) located between the at least two driving pins (64, 640), when rotating the rotatable member (60), one of the at least two driving pins (64, 640) pushes the spring (51) which rotates the pawl (40) and the engaging teeth (42) of one of the two ends of the front of the pawl (40) are engaged with the internal teeth (11) in the ring-shaped head (100).

2. The ratchet wrench as claimed in claim 1, wherein the pawl (40) has a passage defined therethrough and the pivot (43) securely extends through the passage.

3. The ratchet wrench as claimed in claim 1, wherein an annular recess (65) is defined in the underside of the rotatable member (60) and a spring (83) has a first end engaged with the annular recess (65), a second end of the spring (83) contacts the fixing disk (30).

4. The ratchet wrench as claimed in claim 1, wherein two end pieces (50, 52) are respectively connected to the first and second ends of the spring (51), one of the end pieces (52) is engaged with the reception hole (222) and the other one of the end pieces (50) contacts one of the curved surfaces (45).

5. The ratchet wrench as claimed in claim 1, wherein the at least one reception recess (221) includes two reception recesses (221) which are defined in the outer surface of the driving head (20), each of the two reception recesses (221) has a control unit (4) received therein, the fixing disk (30) has two second holes (32) and two slots (33), the rotatable member (60) has two pairs of the driving pins (64).

6. The ratchet wrench as claimed in claim 1, wherein the at least one reception recess (221) includes three reception recesses (221) which are defined in the outer surface of the driving head (20), each of the two reception recesses (221) has a control unit (4) received therein, the fixing disk (30) has three second holes (32) and three slots (33), the rotatable member (60) has three pairs of the driving pins (64).

7. The ratchet wrench as claimed in claim 1, wherein the driving head (20) has a first passage (25) defined therethrough which has a stepped inner periphery, the engaging portion (24) has a bead hole (26) defined in side thereof and communicating with the first passage (25), a control shaft (81) extends through the first passage (25) and has a bead recess (811) defined therein which is located corresponding to the bead hole (26), the control shaft (81) has a connection portion (812) on a top thereof, the bore (61) of the rotatable member (60) has a button (82) and a spring (83) received therein, the button (82) is connected to the connection portion (812) of the control shaft (81), the spring (83) contacts between the lip (62) and the button (82), a bead (84) is located in the bead recess (811) and the bead hole (26).

8. The ratchet wrench as claimed in claim 7, wherein the connection portion (812) has outer threads and the button (82) has a threaded hole (820) defined in an underside thereof, the outer threads of the connection portion (812) are engaged with the threaded hole (820).

9. The ratchet wrench as claimed in claim 7, wherein the connection portion (812) is an annular groove and the button (82) is engaged with the connection portion (812).

10. The ratchet wrench as claimed in claim 7, wherein the bore (61) includes a groove (611) defined in the inner periphery thereof and the button (82) has multiple hooks (821) on a periphery thereof, the hooks (821) engaged with the groove (611), a clip (85) is engaged with the top of the control shaft (81), the top of the control shaft (81) contacts the underside of the button (82), the spring (83) is biased between the clip (85) and the clip (70).

11. The ratchet wrench as claimed in claim 1, wherein the at least one reception recess (221) has two parallel notches (224) defined in the inside thereof and the reception hole (222) is located between the two notches (224), the at least two driving pins (64, 640) engaged with the notches (224).

12. The ratchet wrench as claimed in claim 1, wherein the rotatable member (60) has patterns defined in a top surface thereof.

* * * * *